US006267098B1

(12) United States Patent
Vanderpoel

(10) Patent No.: US 6,267,098 B1
(45) Date of Patent: Jul. 31, 2001

(54) VALVE OPERATING SYSTEM HAVING FULL AUTHORITY LOST MOTION

(75) Inventor: Richard Vanderpoel, Bloomfield, CT (US)

(73) Assignee: Diesel Engine Retarders, Inc., Christiana, DE (US)

( * ) Notice: Subject to any disclaimer, the term of this patent is extended or adjusted under 35 U.S.C. 154(b) by 0 days.

(21) Appl. No.: 09/198,523

(22) Filed: Nov. 24, 1998

Related U.S. Application Data

(60) Provisional application No. 60/066,411, filed on Nov. 24, 1997.

(51) Int. Cl.[7] ..... F02D 13/04; F01L 9/02

(52) U.S. Cl. ..... 123/321; 123/90.12; 123/90.15

(58) Field of Search ..... 123/90.12, 90.13, 123/90.15, 90.16, 90.17, 90.24, 321

(56) References Cited

U.S. PATENT DOCUMENTS 5,255,641 * 10/1993 Schechter ..... 123/90.11
5,419,301 * 5/1995 Schechter ..... 123/673
5,503,120 * 4/1996 Shirey et al. ..... 123/90.17
5,537,976 * 7/1996 Hu ..... 123/322

* cited by examiner

*Primary Examiner*—Henry C. Yuen
*Assistant Examiner*—Mahmoud M Gimie
(74) *Attorney, Agent, or Firm*—David R. Yohannan; Collier Shannon Scott, PLLC

(57) ABSTRACT

A valve actuation system for an internal combustion engine is disclosed. The system includes two hydraulic plungers (master pistons) that are selectively hydraulically coupled to a slave piston. The hydraulic motion from one of the hydraulic plungers may provide a valve opening motion to the slave piston and the hydraulic motion from the other hydraulic plunger may provide a valve closing motion. The net hydraulic motion of both hydraulic plungers may be zero, so that when both plungers have hydraulic communication with the slave piston, no slave piston motion occurs. The system may provide full authority over all engine valve actuations, such as main intake, main exhaust, compression release, and exhaust gas recirculation.

27 Claims, 5 Drawing Sheets

VALVE OPERATING SYSTEM HAVING FULL AUTHORITY LOST MOTION

CROSS REFERENCE TO RELATED PATENT APPLICATION

This application relates to and claims priority on provisional application Ser. No. 60/066,411 filed Nov. 24, 1997 and entitled "Valve Operating System Having Full Authority Lost Motion".

FIELD OF THE INVENTION

The present invention relates to a valve operating system for controlling intake and/or exhaust valve events for an internal combustion engine. In particular, the valve operating system incorporates a hydraulic lost motion system that may provide full authority over all intake and exhaust valve motions.

BACKGROUND OF THE INVENTION

In many internal combustion engines the engine cylinder intake and exhaust valves may be opened and closed by fixed profile cams in the engine, and more specifically by one or more fixed lobes which may be an integral part of each of the cams. The use of fixed profile cams makes it difficult to adjust the timings and/or amounts of engine valve lift to optimize valve opening times and lift for various engine operating conditions, such as different engine speeds. Sophisticated engine control, however, requires variable valve timing and variable valve lift. Furthermore, valve opening and closing velocity should be controlled.

One method of adjusting valve timing and lift, given a fixed cam profile, has been to incorporate a "lost motion" device in the valve train linkage between the valve and the cam. Lost motion is the term applied to a class of technical solutions for modifying the valve motion proscribed by a cam profile with a variable length mechanical, hydraulic, or other linkage means. In a lost motion system, a cam lobe may provide the "maximum" (longest dwell and greatest lift) motion needed over a full range of engine operating conditions. A variable length system may then be included in the valve train linkage, intermediate of the valve to be opened and the cam providing the maximum motion, to subtract or lose part or all of the motion imparted by the cam to the valve.

This variable length system (or lost motion system) may, when expanded filly, transmit all of the cam motion to the valve, and when contracted fully, transmit none or a minimum amount of the cam motion to the valve. Examples of such a system and method are provided in Vorih U.S. Pat. No. 5,829,397 and Hu U.S. Pat. No. 5,537,976, which are assigned to the same assignee as the present application, and which are incorporated herein by reference.

In a lost motion system an engine cam shaft may actuate a master piston which displaces fluid from its hydraulic chamber into a hydraulic chamber of a slave piston. The slave piston in turn acts on the engine valve to open it. The lost motion system may be a solenoid valve and a check valve in communication with the hydraulic circuit including the chambers of the master and slave pistons. The solenoid valve may be maintained in a closed position in order to retain hydraulic fluid in the circuit. As long as the solenoid valve remains closed, the slave piston and the engine valve respond directly to the motion of the master piston, which in turn displaces hydraulic fluid in direct response to the motion of a cam. When the solenoid is opened temporarily, the circuit may partially drain, and part or all of the hydraulic pressure generated by the master piston may be absorbed by the circuit rather than be applied to displace the slave piston.

Prior to the present invention, few lost motion systems have provided fully variable degrees of valve lift and dwell. Such variability in lost motion systems has been attained by rapid release of hydraulic pressure from the slave piston in order to close the engine valve connected to the slave piston. Valve closing motions that are dictated by the rapid release of hydraulic pressure tend to result in undesirably high valve closing velocities. This results in unacceptably short closing durations at low speed. There is a need for a lost motion system in which valve closing angles may be kept constant through the engine speed range. This device may be used with valve seating control devices to control valve seating velocities.

Previous lost motion systems have used a single cam to drive the master piston—slave piston combination in the system. Accordingly, valve motion must either come from a direct hydraulic following of the single cam profile, or some version of that profile minus the motion "lost" by the system. Controlled loss of hydraulic actuation may require complicated control valves and controllers capable of throttling the release of hydraulic pressure from the salve piston. Controlled loss of hydraulic actuation may also require selection of a system tuned to provide optimum release of hydraulic pressure for only one set of engine conditions.

In the present invention, high speed control valves may switch the cam profile that is hydraulically connected to the slave piston. Thus, the system may provide a range of valve actuation from multiple cam profiles. By using high speed mechanisms to select particular cam profiles for valve opening and closing, more precise control may be attained over valve actuation, and accordingly optimal valve actuation may be attained for a wide range of engine operating conditions.

Applicant has determined that the lost motion system and method of the present invention may be particularly useful in engines requiring valve actuation for both positive power and for compression release retarding and exhaust gas recirculation valve events.

An example of a lost motion system and method used to obtain retarding and exhaust gas recirculation is provided by the Gobert, U.S. Pat. No. 5,146,890 (Sep. 15, 1992) for a Method And A Device For Engine Braking A Four Stroke Internal Combustion Engine, assigned to AB Volvo, and incorporated herein by reference. Gobert discloses a method of conducting exhaust gas recirculation by placing the cylinder in communication with the exhaust system during the first part of the compression stroke and optionally also during the latter part of the inlet stroke. Gobert uses a lost motion system to enable and disable retarding and exhaust gas recirculation, but such system is not variable within an engine cycle.

None of the lost motion systems or methods of the prior art have enabled precise control of valve actuation to optimize valve movement for different engine operating conditions. Furthermore, none of the lost motion systems or methods of the prior art disclose, teach or suggest the use of high speed control valves to switch the cam profile driving a slave piston during a single valve event. Independent control over valve lift and dwell may be realized by cam profile switching. In addition, none of the prior art discloses, teaches or suggests any system or method for using such a cam profile switching arrangement to control and/or reduce engine valve seating velocities.

Accordingly, there is a significant need for a system and method of controlling lost motion which: (i) optimizes engine operation under various engine operating conditions; (ii) provides precise control of lost motion; (iii) provides acceptable valve closing velocities; and (iv) is capable of providing all intake and exhaust valve events.

OBJECTS OF THE INVENTION

It is therefore an object of the present invention to provide a hydraulic lost motion system capable of providing full authority over all intake and exhaust valve motions.

It is another object of the present invention to provide full authority valve motion without the use of a proportional controller or proportional control valves.

It is yet another object of the present invention to provide a system and method for optimizing engine operation under various engine operating conditions by valve actuation control.

It is a still a further object of the present invention to provide a system and method for providing precise control of the lost motion in a valve train.

It is yet another object of the present invention to provide control over valve opening and closing velocity.

It is still another object of the invention to provide a lost motion system in which a slave piston is in selective hydraulic communication with more than one master piston or hydraulic plunger.

SUMMARY OF THE INVENTION

In response to this challenge, Applicant has developed an innovative, economical valve actuation system having a slave piston for providing engine valve actuation motion, comprising: first and second hydraulic plungers; a slave piston; a hydraulic fluid supply; a hydraulic fluid system operatively connecting the first and second hydraulic plungers to both the slave piston and the hydraulic fluid supply; a first control valve positioned in the hydraulic fluid system to provide selective hydraulic communication of the first hydraulic plunger with the slave piston and the hydraulic fluid supply; and a second control valve positioned in the hydraulic fluid system to provide selective hydraulic communication of the second hydraulic plunger with the slave piston and the hydraulic fluid supply.

It is to be understood that both the foregoing general description and the following detailed description are exemplary and explanatory only. And are not restrictive of the invention as claimed. The accompanying drawings, which are incorporated herein by reference and which constitute apart of the specification, illustrate certain embodiments of the invention and, together with the detailed description, serve to explain the principles of the present invention.

BRIEF DESCRIPTION OF THE DRAWINGS

Various embodiments of the present invention will now be described in connection with the following figures in which like reference numbers refer to like elements and wherein.

DETAILED DESCRIPTION OF THE INVENTION

Figure 1:
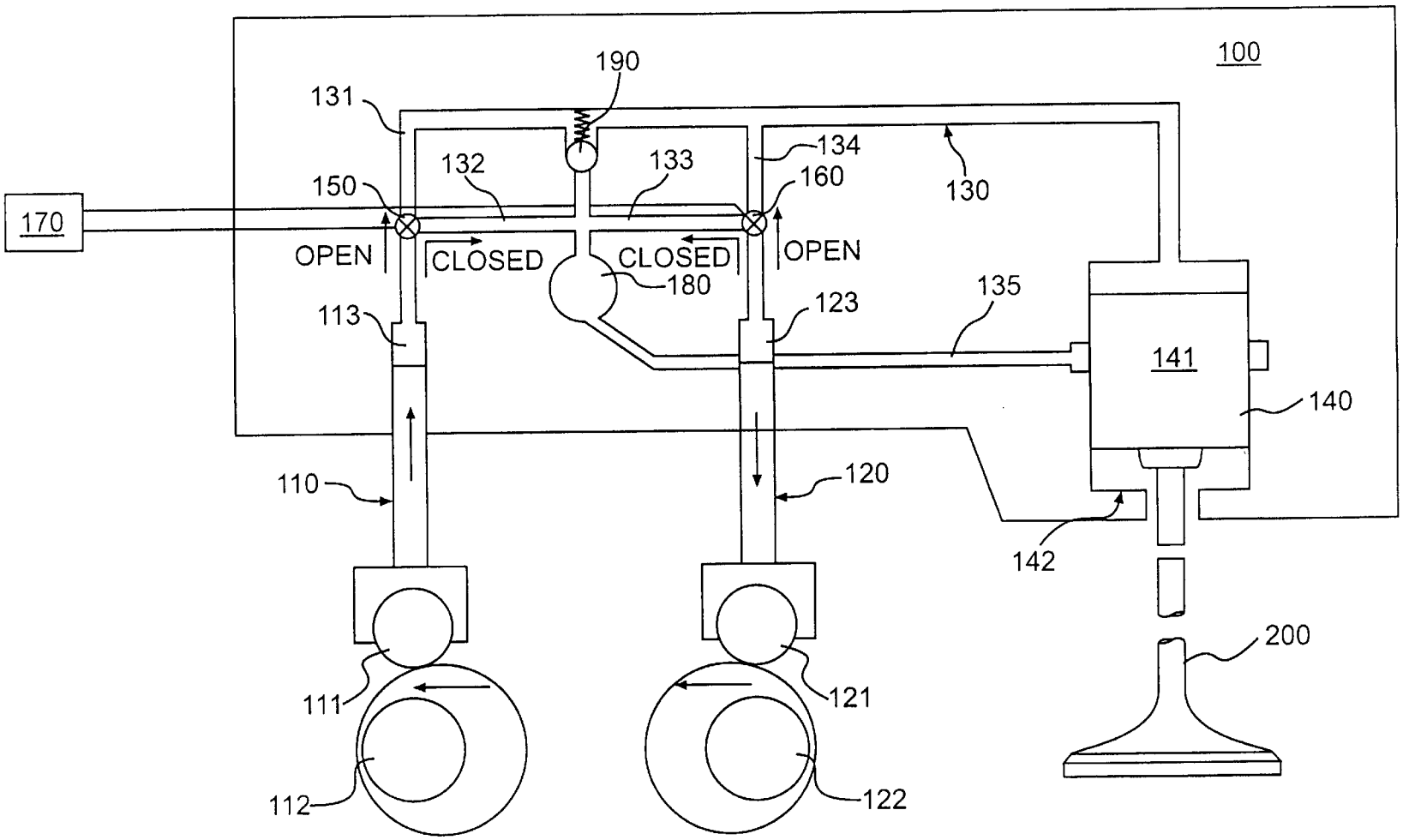
FIG. 1 is a schematic view of the valve operating system according to a preferred embodiment of the present invention.

Reference will now be made in detail to a preferred embodiment of the invention, an example of which is illustrated in the accompanying drawings. Referring first to FIG. 1, which is a schematic illustration of a valve operating system 100 for an engine valve 200 in an internal combustion engine. The valve operating system 100 includes a first hydraulic plunger 110 slidably disposed in a first hydraulic chamber 113. A portion of the first plunger 110 extends out of the first hydraulic chamber 113 to make contact with a first cam follower 111. The first cam follower 111 transforms rotary motion received from a first cam profile 112 into a reciprocal linear displacement of the first plunger 110 in the first plunger chamber 113. A second hydraulic plunger 120 is slidably disposed in a second hydraulic chamber 123. A second cam follower 121 operatively connects the second hydraulic plunger 120 with a second cam profile 122.

A hydraulic fluid system 130 provides hydraulic communication between the first and second hydraulic plungers 110 and 120 and a slave piston assembly 140. The hydraulic fluid system 130 includes a passage 131, and first and second bypass passages, 132 and 133. A first control valve 150 is provided in the hydraulic fluid system 130 at the intersection of the passage 131 and the first bypass passage 132. A second control valve 160 is provided in the hydraulic fluid system 130 at the intersection of the passage 134 and the second bypass passage 133. A hydraulic fluid supply 180 is connected to the hydraulic fluid system 130 at the intersection of the first and second bypass passages 132 and 133. The hydraulic fluid supply 180 may include an accumulator. A one-way check valve 190 may be positioned in the hydraulic fluid system 130 between the hydraulic fluid supply 180 and the passage 131.

The first and second control valves 150 and 160 may be three-way valves. The first control valve 150 provides hydraulic communication alternatively between the first plunger chamber 113 and the first bypass passage 132, or between the first plunger chamber 113 and passage 131. The second control valve 160 provides hydraulic communication alternatively between the second plunger chamber 123 and the second bypass passage 133, or between the second plunger chamber 123 and passage 134. Thus, the first control valve 150 provides for selective hydraulic communication of the first hydraulic plunger 110 with the slave piston assembly 140 and the second control valve 160 provides for selective hydraulic communication of the second hydraulic plunger 120 with the slave piston assembly 140.

The slave piston assembly 140 includes a slave piston 141 slidably disposed in a slave piston chamber 142. The slave piston 141 is operatively connected with an internal combustion engine valve 200, such as an exhaust valve or intake valve. A return passage 135 for hydraulic fluid may connect the slave piston chamber 142 with the hydraulic fluid supply 180. The return passage 135 may open into the slave piston chamber 142 such that the return passage is blocked by the slave piston 141 when the piston is at the top of its stroke. Sufficient downward displacement of the slave piston 141 in the chamber 142 may result in the return passage 135 becoming unblocked allowing the return of hydraulic fluid from the chamber 142 to the hydraulic fluid supply 180. The return passage 135 limits the downward stroke of the slave piston 141.

With continued reference to FIG. 1, the valve actuation system 100 may operate as follows. The hydraulic fluid system 130 and plunger chambers 113 and 123 are charged with hydraulic fluid (e.g oil) from the hydraulic fluid supply 180. At this time the first and second control valves 150 and 160 are in a closed position so that they provide hydraulic communication between the bypass passages 132 and 133 and the plunger chambers 113 and 123, respectively. The hydraulic fluid in the system 130 is at a relatively low pressure (e.g 20 to 100 psi).

Charging the system 100 with hydraulic fluid assures that the hydraulic plungers 110 and 120 and associated cam followers 111 and 121 engage the cam profiles 112 and 122. Operation of the internal combustion engine results in rotation of the cam profiles 112 and 122. One or more lobes on the cam profiles 112 and 122 produce corresponding displacements of the first and second hydraulic plungers 110 and 120. In the preferred embodiment of the invention, each cam profile 112 and 122 includes one lobe that produces some degree of hydraulic plunger displacement for much of the rotation of the cam profile. For almost half of the cam profile 112 and 122 rotations, the hydraulic plungers 110 and 120 are in the process of being displaced upward into the plunger chambers 113 and 123, respectively. For most of the other half of the cam profile rotations, the hydraulic plungers 110 and 120 are in the process of being retracted back towards the base circle of the cam profiles 112 and 122. Each cam profile 112 and 122 remains at base circle for only a short duration (approximately 45 degrees of cam rotation).

Figure 2:
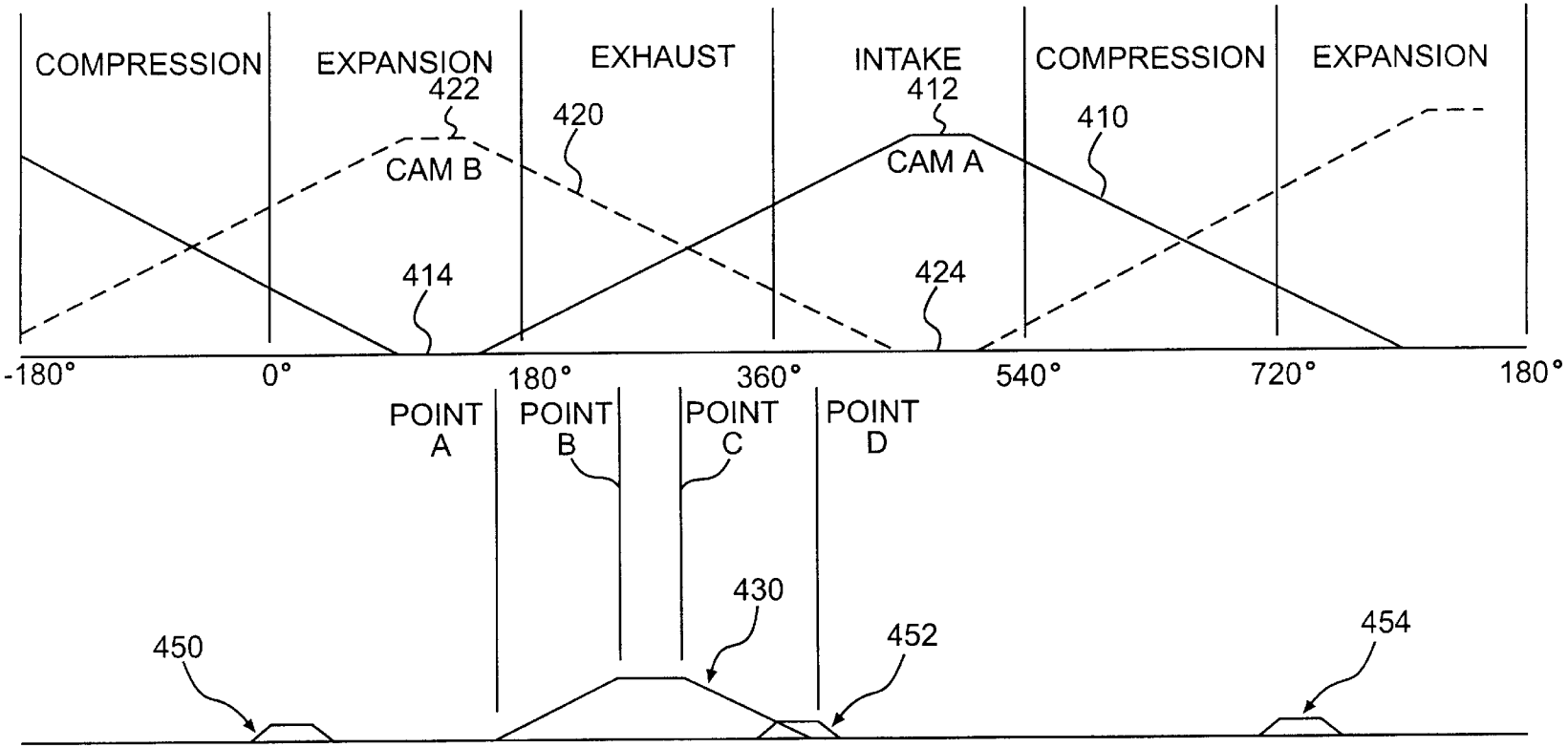
FIG. 2 is a graph illustrating available slave piston displacement and valve motion versus cam rotation for main exhaust, two-cycle compression release braking, and four-cycle compression release braking valve events.

The top portion of FIG. 2 illustrates the relative available hydraulic displacements 410 and 420 produced in response to cam profiles 112 and 122 that may be applied to the slave piston 141. As shown in FIG. 2, the displacements produced by these cam profiles are preferably "out of phase," that is, the first hydraulic plunger 110 is being displaced upward when the second hydraulic plunger 120 is being retracted towards base circle, and visa-versa. In the preferred embodiment of the invention the cam profiles 112 and 122 are about 180 degrees out of phase. The available maximum displacement 412 and 422 provided by each cam profile 112 and 122 is limited by the positioning of the return passage 135. The location of the intersection of the return passage 135 with the slave piston chamber 142 determines the maximum downward displacement of the slave piston 141.

The hydraulic plungers 110 and 120 are displaced into the plunger chambers 113 and 123 in response to the cam profiles 112 and 122. As shown in FIG. 1, the first hydraulic plunger 110 is being displaced upward into the plunger chamber 113, while the second hydraulic plunger 120 is being retracted out of the plunger chamber 123.

The first control valve 150 is positioned within the hydraulic fluid system 130 to control the transfer of motion from the first cam profile 112 to the slave piston assembly 140. The second control valve 160 is positioned within the fluid system 130 to control the transfer of motion from the second cam profile 122 to the slave piston assembly 140. The control valves 150 and 160 are preferably trigger valves that are either fully open or completely closed. As a result, the control valves 150 and 160 may not throttle the flow of hydraulic fluid for an appreciable length of time. This permits the use of simpler valves, which may reduce power consumption. The embodiment of the present invention shown in FIG. 1 may utilize a relatively simple controller 170 for the control valves 150 and 160 because the control signals for the control valves are either "on" or "off" signals.

The operation of the valve operating system 100 to produce a normal four cycle exhaust event during positive power will now be described in connection with the lower portion of FIG. 2. The system 100 is first charged with hydraulic fluid as described above. Prior to point a, both control valves 150 and 160 are closed. Hydraulic fluid displaced by the plungers 110 and 120 in response to cam profiles 112 and 122 is displaced into the low pressure supply 180, which may incorporate an accumulator. As a result, no hydraulic fluid is displaced in to the slave piston chamber 142, and the slave piston 141 does not move.

At point a the first control valve 150 is opened in response to the controller 170 and the first hydraulic chamber 113 is placed in communication with the slave piston assembly 140 through the main passage 131. Hydraulic fluid displaced by the first plunger 110 forces the slave piston 141 downward. The downward displacement of the slave piston 141 opens the engine valve 200 at a rate determined by the valve opening motion of the first cam profile 112 (curve 412 of FIG. 2) and the hydraulic ratio of the first plunger chamber 113 to the slave piston chamber 142. The second control valve 160 remains closed past point a so that the hydraulic fluid displaced by the second hydraulic plunger 120 is shunted through the second bypass passage 133 to the hydraulic fluid supply 180. The second hydraulic plunger 120 is effectively taken out of the hydraulic circuit that includes the slave piston assembly 140 by keeping the second control valve 160 closed.

At point b the second control valve 160 is opened. The second hydraulic plunger 120 is still retracting when the second control valve 160 is opened at point b. The retraction of hydraulic fluid from the hydraulic fluid system 130 by the second plunger 120 (as it moves downward) preferably matches and cancels out the positive displacement of hydraulic fluid by the first plunger 110. As a result, there is no net additional hydraulic force on the slave piston 141 while both of the control valves 150 and 160 are open between points b and c. The slave piston 141 maintains a constant displacement in the slave piston chamber 142 and the engine valve 200 dwells or remains in an open position between points b and c.

At point c the first control valve 150 is closed and the second control valve 160 is kept open. The slave piston 141 then closes the engine valve 200 responsive to the valve closing motion provided by the second cam profile 122 (curve 422 of FIG. 2). The engine valve 200 is seated just before point d. Low pressure hydraulic fluid may then flow through the check valve 190 to maintain bringing the hydraulic fluid system 130 add a fixed pressure despite additional retraction by the second plunger 160. At point d, both control valves 150 and 160 are closed and the engine valve 200 may dwell at this position until the next cycle.

This action has produced a normal positive power exhaust valve motion as illustrated by curve 430, FIG. 2. Opening and closing of control valves 150 and 160 determines the timing, lift, and dwell of the exhaust valve motion. This motion is fully adjustable within the limits of the displacement of cams 112 and 122 and may be varied with speed or load as desired. The engine valve 200 may even be opened and closed in steps if desired, however the rate of opening and closing would be controlled by the cam profiles 112 and 122.

It is contemplated that the valve operating system 100 may also be used to accomplish "two-cycle" braking as illustrated by curves 450, 452 and 454 of FIG. 2. Two-cycle braking may be obtained by modifying the opening and closing of valves 150 and 160 to different timings.

First and third two-cycle braking events 450 and 454 may be achieved using the hydraulic displacement 420 from the second hydraulic plunger 120 for the "opening" portions of the events. The "closing" portions of events 450 and 454 are provided using the hydraulic displacement 410 from the first hydraulic plunger 110. The level middle portions of the events 450 and 454 may be attained by cancellation of the positive hydraulic displacement 420 with the negative hydraulic displacement 410.

The second two-cycle braking event 452 may be attained by using the hydraulic displacement 420 from the second hydraulic plunger 120 to provide a valve closing motion, and using the hydraulic displacement 410 from the first hydraulic plunger 110 to provide a valve opening motion.

Figure 3:
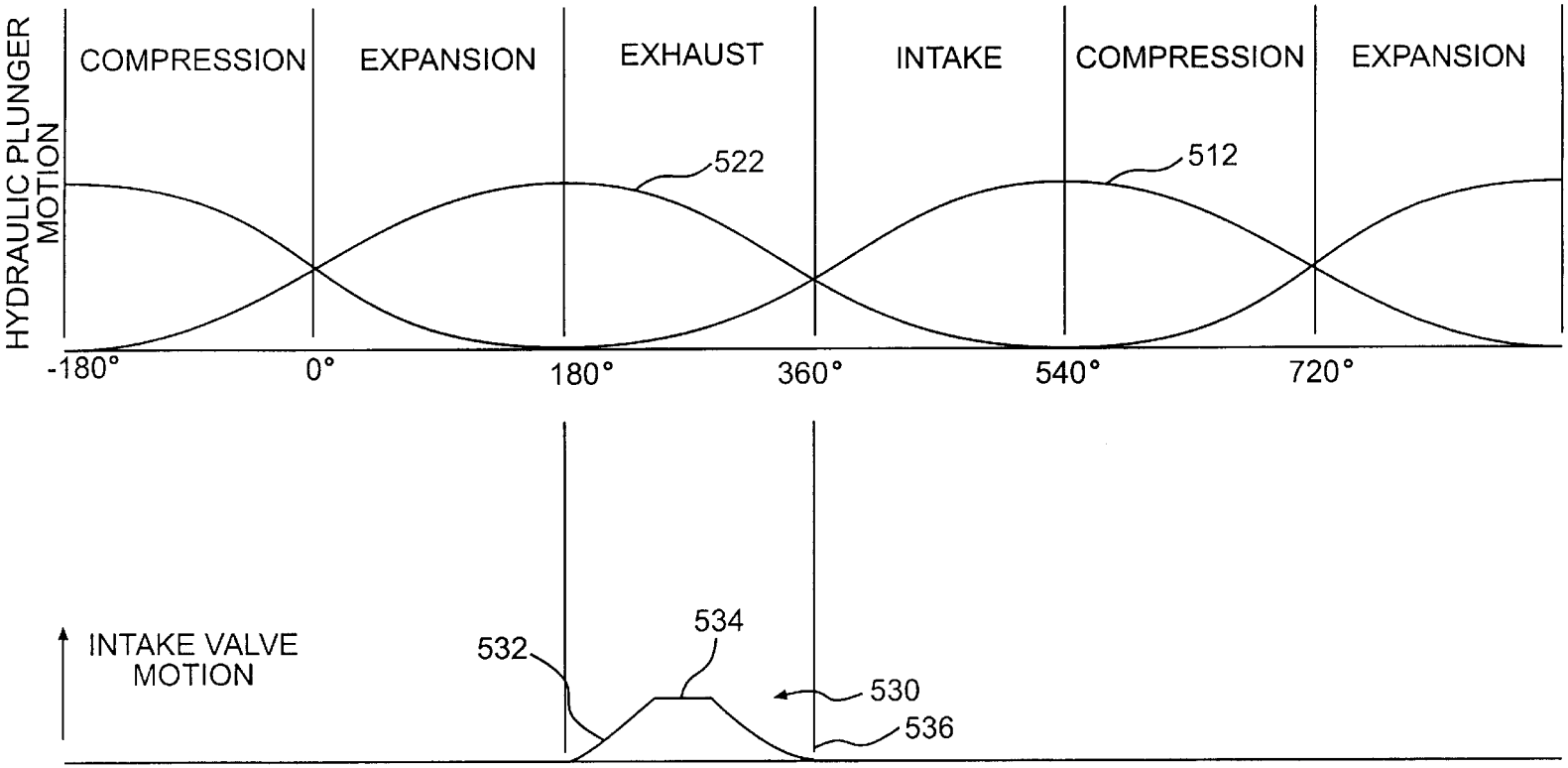
FIG. 3 is a graph illustrating available slave piston displacement and valve motion versus cam rotation for a main intake valve event.

With reference to FIGS. 1 and 3, a similar arrangement and control sequence for a slave piston 141 connected to an intake engine valve 200 may provide intake valve motion 530 as opposed to exhaust valve motion. With reference to FIG. 3, the opening motion 532 for the intake valve may be provided by the positive hydraulic displacement 512 of the first hydraulic plunger. The steady dwell 534 in an open position may be provided by the cancellation of the positive hydraulic displacement 512 of the first hydraulic plunger with the negative hydraulic displacement 522 of the second hydraulic plunger. The closing motion 536 for the intake valve may be provided by the negative displacement (retraction) 522 of the second hydraulic plunger.

With reference to FIGS. 2 and 3, the positive hydraulic displacements 412 and 512 provided by the first hydraulic plunger may slightly exceed the negative hydraulic displacements 422 and 522 provided by the second hydraulic plunger. The extra positive hydraulic displacement may make up for expected hydraulic leakage losses, so that the positive hydraulic displacements 412 and 512 more nearly cancel out with their respective negative hydraulic displacement counterparts 422 and 522 during the dwell periods 534.

The positive and negative hydraulic displacements 412, 512, 422 and 522 may also be non-linear over portions of the engine cycle. For example, with regard to FIG. 3, a steep or rapid opening motion 532 provided by the positive hydraulic displacement 512 enables the intake valve to quickly attain a desired lift, thereby providing for a greater mass of air to enter the cylinder. A gradually decreasing closing motion 536 provided by the negative hydraulic displacement 522 enables the intake valve to be closed and seated more gently, thereby decreasing the cyclical mechanical stress on the valve.

It is also appreciated that each of the cam profiles 112 and 122 shown in FIG. 1 may include more than one valve opening-closing lobe in an alternative embodiment of the invention. The cam profiles 112 and 122 are each shown with one lobe in FIG. 1, however, it is not intended that the invention be limited to use with only these cam profiles. By providing cam profiles with more than one opening-closing lobe per profile, additional options for valve actuation may be built into the system. The motion attributable to each lobe on the cam profiles may be selectively lost or transferred to a slave piston by the system via the use of the control valves 150 and 160.

Figure 4:
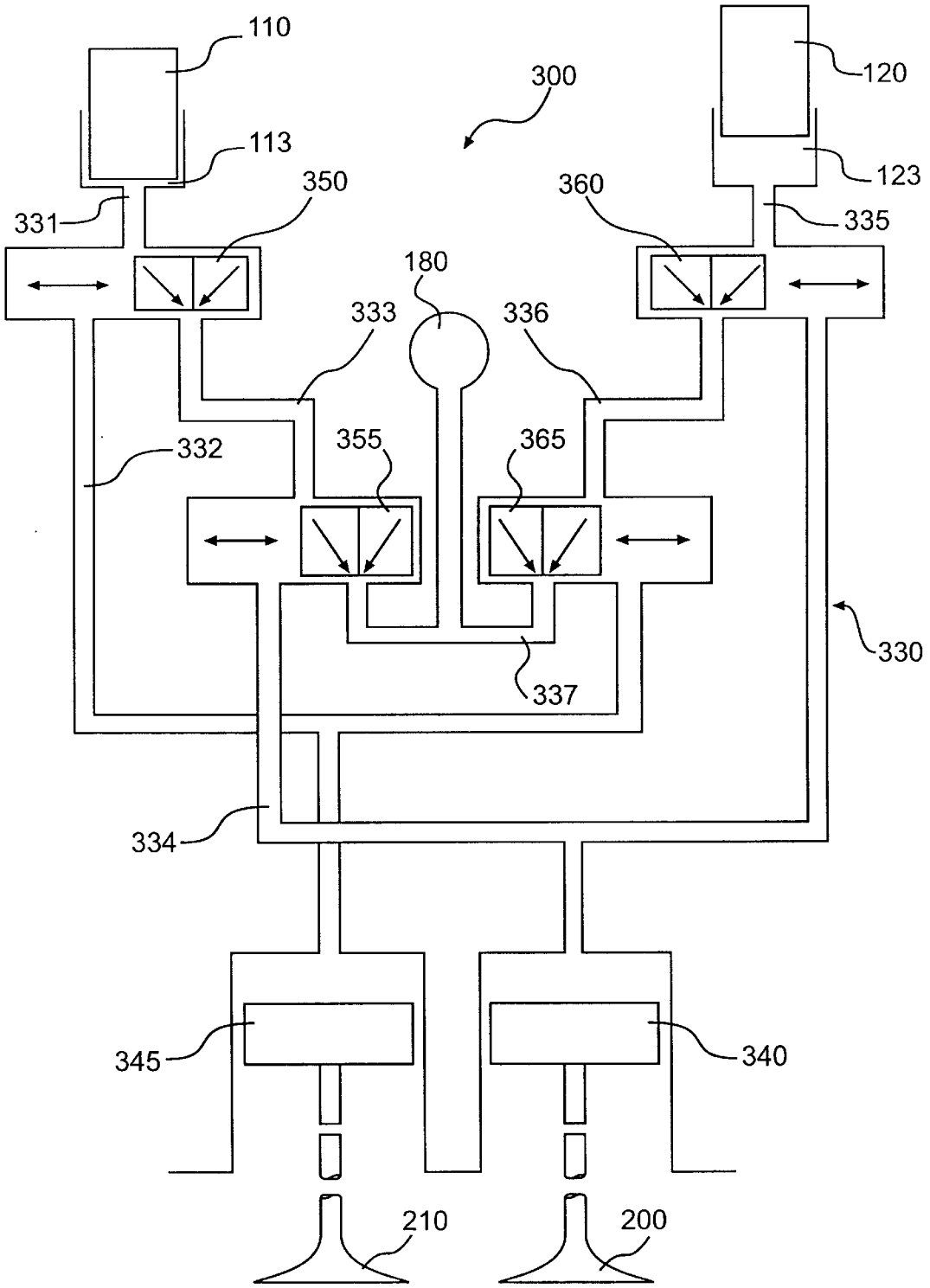
FIG. 4 is a schematic view of the valve operating system according to an alternative embodiment of the present invention.

With reference to FIG. 4, in an alternative embodiment of the present invention the operation of both an exhaust valve 200 and an intake valve 210 may be controlled using a valve actuation system 300. The valve actuation system 300 includes a first hydraulic plunger 110 having a cam follower (not shown). The cam follower follows a first cam profile (not shown) as described above in connection with the valve actuation system 100 of FIG. 1. The valve actuation system 300 includes a second hydraulic plunger 120 having a cam follower (not shown). The cam follower follows a second cam profile (not shown) as described above in connection with FIG. 1.

A hydraulic fluid system 330 provides selective hydraulic communication of the first and second plungers 110 and 120 with the exhaust valve slave piston assembly 340 and the intake slave piston assembly 345. Motion generated in response to the first and second 110 and 120 is transferred through the hydraulic fluid system 330 to operate the exhaust and intake slave piston assemblies 340 and 345.

A first control valve 350 is positioned in the hydraulic fluid system 330 to provide selective hydraulic communication of the first hydraulic plunger 110 with the intake slave piston assembly 345 and a second control valve 355. The second control valve 355 is positioned in the hydraulic fluid system 330 to provide selective hydraulic communication of the first hydraulic plunger 110 with the exhaust slave piston assembly 340 and a hydraulic fluid supply 180. The hydraulic fluid system 330 and the first and second control valves 350 and 355 are collectively, one of a variety of possible means for providing selective hydraulic fluid communication between the first hydraulic plunger 110 and each of: (a) the intake slave piston assembly 345, (b) the exhaust slave piston assembly 340, and (c) the hydraulic fluid supply 180.

A third control valve 360 is positioned in the hydraulic fluid system 330 to provide selective hydraulic communication of the second hydraulic plunger 120 with the exhaust slave piston assembly 340 and a fourth control valve 365. The fourth control valve 365 is positioned in the hydraulic fluid system 330 to provide selective hydraulic communication of the second hydraulic plunger 120 with the intake slave piston assembly 345 and the hydraulic fluid supply 180. The hydraulic fluid system 330 and the third and fourth control valves 360 and 365 are collectively, one of a variety of possible means for providing selective hydraulic fluid communication between the second hydraulic plunger 120 and each of: (a) the intake slave piston assembly 345, (b) the exhaust slave piston assembly 340, and (c) the hydraulic fluid supply 180.

When the first control valve 350 is in a first position, the motion generated by first plunger 110 is directed to the intake slave piston assembly 345 through fluid passageway 332. The intake slave piston assembly 345 operates an intake valve 210. When the first control valve 350 is in a second position, the motion generated by first plunger 110 is directed to through fluid passageway 333 to the second control valve 355.

When the second control valve 355 is in a first position and the first control valve 350 is in the second position, the motion generated by first plunger 110 is directed through passageways 333 and 334 to the exhaust slave piston assembly 340 to operate an exhaust valve 200. When the second control valve 355 is in a second position and the first control valve 350 is in the second position, the motion generated by the first plunger 110 is directed through passageways 333 and 337 to a fluid supply or accumulator 180.

When the third control valve 360 is in a first position, the motion generated by second plunger 120 is directed to the exhaust slave piston assembly 340 through fluid passageway 330. The exhaust slave piston assembly 340 operates the exhaust valve 200. When the third control valve 360 is in a second position, the motion generated by the second plunger 120 is directed to through fluid passageway 336 to the fourth control valve 365.

When the fourth control valve 365 is in a first position and the third control valve 360 is in the second position, the motion generated by second plunger 120 is directed through passageways 336 and 332 to the intake slave piston assembly 345 to operate the intake valve 210. When the fourth control valve 365 is in a second position and the third control valve 360 is in the second position, the motion generated by the second plunger 120 is directed through passageways 336 and 337 to a fluid supply or accumulator 180.

The switching of each of the first, second, third and fourth control valves (350,355,360, and 365) back and forth between the first and second positions may be controlled by a controller (not shown). The controller may have electrical connections, or other communication, with each of the control valves in order to direct the control valve to switch to its alternative position.

An examplary opening of the exhaust valve 200 using the valve actuation system 300 will now be described in connection with FIG. 4. The exhaust valve 200 is operated by the exhaust slave piston assembly 340. When the third control valve 360 is in a first position (the third control valve is shown in its "second" position), the motion generated by the second plunger 120 is directed to the exhaust slave piston assembly 340 to open the exhaust valve 200 in the manner illustrated in FIG. 2 between points a and b. The exhaust valve 200 is maintained in an open position (as illustrated between points b and c) by moving the first control valve 350 to its second position (shown) and the second control valve 355 to its first position (not shown). This causes motion from the first plunger 110 to be transferred to the exhaust slave piston assembly 340. There is no net flow of hydraulic fluid into the exhaust slave piston assembly 340 when both the negative hydraulic displacement of the first plunger 110 and the positive hydraulic displacement of the second plunger 120 are transferred to the exhaust slave piston assembly. During this time the exhaust valve 200 will dwell or remain in the open position, in the manner illustrated in FIG. 2 between points b and c. The exhaust valve 200 may be closed by moving the third control valve 360 to its second position so that the exhaust slave piston assembly 340 is hydraulically locked with only the retracting first plunger 110. The exhaust slave piston assembly 340 may then close the exhaust valve 200 at a controlled rate, in the manner illustrated in FIG. 2 between points c and d.

With continued reference to FIG. 4, the opening and closing of the exhaust valve 200 and the intake valve 210 may be controlled in a similar manner to that discussed immediately above. Control of the first, second, third, and fourth control valves 350, 355, 360 and 365 may be used to produce smooth valve operation for all intake and exhaust valve events such as main intake, main exhaust, compression release braking, and exhaust gas recirculation.

Figure 5:
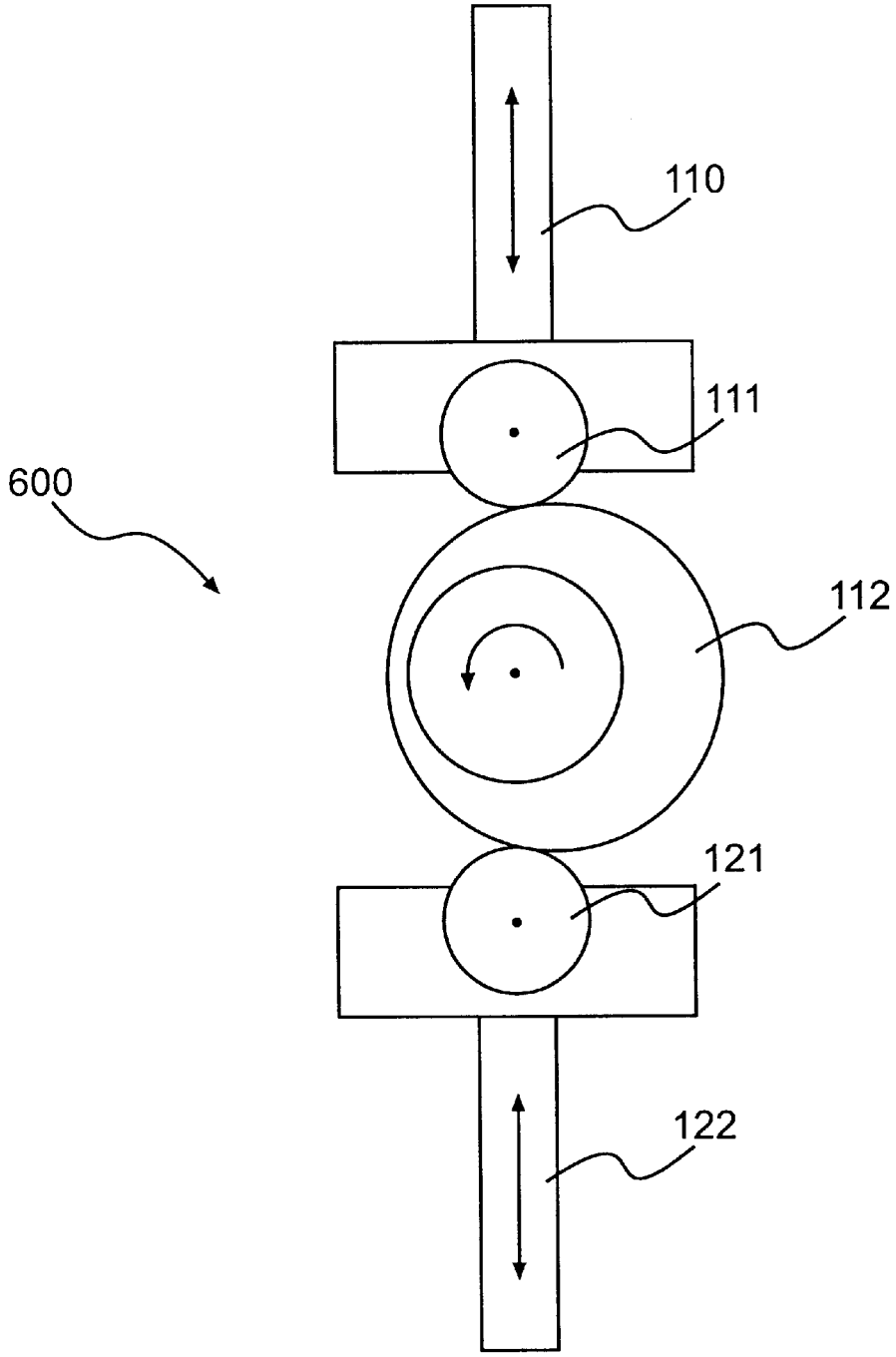
FIG. 5 is a schematic view of an alternative cam profile and cam follower arrangement that may be used in the valve operating systems shown in FIGS. 1 and 4.

Each of the valve actuation systems 100 and 300 shown in FIGS. 1 and 4, respectively may use an alternative cam profile and cam follower arrangement 600 shown in FIG. 5. The arrangement 600 requires only a single cam profile 112 to provide the hydraulic displacements to both the first and second hydraulic plungers 110 and 120. Placement of the hydraulic plungers 110 and 120 on opposite (or near opposite) sides of the cam profile 112 allows the same profile to simultaneously provide an opening motion to one plunger and a closing motion to the other plunger.

While the present invention has been described in conjunction with specific embodiments thereof, it is evident that many alternatives, modifications and variations will be apparent to those skilled in the art without departing from the scope and spirit of the invention. For example, each embodiment of the present invention is not limited to the above described first and second plungers 110 and 120. Master pistons and other suitable devices for transmitting the motion of a cam profile to an engine valve are considered to be within the scope of the present invention. Furthermore, variations in the shape and size of the cam profiles may be used to vary the shapes and sizes of the available slave piston actuation curves (e.g. curves 412 and 422 of FIG. 2). Accordingly, the preferred embodiments of the invention as set forth herein are intended to be illustrative, not limiting, and it is intended that the following claims cover all modifications and variations of the invention that may be achieved by one of ordinary skill in the art.

What I claim is:

1. A valve actuation system having a slave piston for providing engine valve actuation motion, comprising:

first and second hydraulic plungers; one or more cams for displacing said plunger out of phase;

a slave piston;

a hydraulic fluid supply;

a hydraulic fluid system operatively connecting the first and second hydraulic plungers to both the slave piston and the hydraulic fluid supply;

a first control valve positioned in the hydraulic fluid system to provide selective hydraulic communication of the first hydraulic plunger with the slave piston and the hydraulic fluid supply;

a second control valve positioned in the hydraulic fluid system to provide selective hydraulic communication of the second hydraulic plunger with the slave piston and the hydraulic fluid supply; and means for controlling the hydraulic communication provided by the first and second control valves such that hydraulic connections provided by the hydraulic fluid system are selected from the group consisting of:

(a) the first and second hydraulic plungers connected to the hydraulic fluid supply, (b) the first hydraulic plunger connected to the hydraulic fluid supply and the second hydraulic plunger connected to the slave piston, (c) the first hydraulic plunger connected to the slave piston and the second hydraulic plunger connected to the hydraulic fluid supply, and (d) the first and second hydraulic plungers connected to the slave piston.

2. The valve actuation system of claim 1, wherein said one or more cams comprises:

a first cam profile operatively connected to the first hydraulic plunger; and a second cam profile operatively connected to the second hydraulic plunger;

wherein plunger displacements produced by the first and second cam profiles are out of phase.

3. The valve actuation system of claim 2 wherein the plunger displacements are 180 degrees out of phase.

4. The valve actuation system of claim 2 wherein the first cam profile is adapted to provide a valve opening motion and the second cam profile is adapted to provide a valve closing motion.

5. The valve actuation system of claim 1 wherein said one or more cams comprises a cam profile operatively connected to the first and second hydraulic plungers such that plunger displacements produced by the first and second hydraulic plungers are out of phase.

6. The valve actuation system of claim 5 wherein the plunger displacements produced by the first and second hydraulic plungers are 180 degrees out of phase.

7. The valve actuation system of claim 5 wherein the first hydraulic plunger displacement is adapted to provide a valve opening motion and the second hydraulic plunger displacement is adapted to provide a valve closing motion.

8. The valve actuation system of claim 1 wherein the hydraulic fluid system operatively connects the first hydraulic plunger, the second hydraulic plunger, the slave piston, and the hydraulic fluid supply; and wherein the valve actuation system further comprises a one-way check valve positioned in the hydraulic fluid system between the hydraulic fluid supply and the slave piston.

9. The valve actuation system of claim 1 further comprising means for controlling the hydraulic communication provided by the first and second control valves such that the slave piston provides a valve actuation event selected from the group consisting of: exhaust gas recirculation, compression-release braking, and main exhaust.

10. The valve actuation system of claim 2 wherein the first cam profile comprises more than one valve opening-closing lobe.

11. The valve actuation system of claim 10 wherein the second cam profile comprises more than one valve opening-closing lobe.

12. A valve actuation system for an internal combustion engine having a slave piston for providing engine valve actuation motion, comprising:

first and second hydraulic plungers;

a slave piston;

a hydraulic fluid supply;

a hydraulic fluid system operatively connecting the first and second hydraulic plungers to both the slave piston and the hydraulic fluid supply;

a first control valve positioned in the hydraulic fluid system to provide selective hydraulic communication of the first hydraulic plunger with the slave piston and the hydraulic fluid supply;

a second control valve positioned in the hydraulic fluid system to provide selective hydraulic communication of the second hydraulic plunger with the slave piston and the hydraulic fluid supply;

a first cam profile operatively connected to the first hydraulic plunger and a second cam profile operatively connected to the second hydraulic plunger, wherein plunger displacements produced by said first and second cam profiles are out of phase; and means for controlling the hydraulic communication provided by the first and second control valves such that hydraulic connections provided by the hydraulic fluid system are selected from the group consisting of:

(a) the first and second hydraulic plungers connected to the hydraulic fluid supply, (b) the first hydraulic plunger connected to the hydraulic fluid supply and the second hydraulic plunger connected to the slave piston, (c) the first hydraulic plunger connected to the slave piston and the second hydraulic plunger connected to the hydraulic fluid supply, and (d) the first and second hydraulic plungers connected to the slave piston.

13. The valve actuation system of claim 12 wherein the plunger displacements produced by the first and second hydraulic plungers are about 180 degrees out of phase.

14. The valve actuation system of claim 13 wherein the first hydraulic plunger displacement is adapted to provide a valve opening motion and the second hydraulic plunger displacement is adapted to provide a valve closing motion.

15. The valve actuation system of claim 14 wherein the means for controlling the hydraulic communication provided by the first and second control valves provides for a valve actuation event selected from the group consisting of: exhaust gas recirculation, compression-release braking, and main exhaust.

16. The valve actuation system of claim 15 wherein the hydraulic fluid system operatively connects the first hydraulic plunger, the second hydraulic plunger, the slave piston, and the hydraulic fluid supply; and wherein the valve actuation system further comprises a one-way check valve positioned in the hydraulic fluid system between the hydraulic fluid supply and the slave piston.

17. The valve actuation system of claim 16 wherein the hydraulic fluid supply includes an accumulator.

18. The valve actuation system of claim 14 wherein the first hydraulic plunger displacement is adapted to provide a valve opening motion for a first engine valve and a valve closing motion for a second engine valve and the second hydraulic plunger displacement is adapted to provide a valve closing motion for the first engine valve and a valve opening motion for the second engine valve.

19. A valve actuation system having an intake slave piston and an exhaust slave piston for providing intake and exhaust engine valve actuation motions, respectively, said valve actuation system comprising:

first and second hydraulic plungers;

intake and exhaust slave pistons;

a hydraulic fluid supply;

means for providing selective hydraulic fluid communication between the first hydraulic plunger and each of: (a) the intake slave piston, (b) the exhaust slave piston, and (c) the hydraulic fluid supply; and means for providing selective hydraulic fluid communication between the second hydraulic plunger and each of: (a) the intake slave piston, (b) the exhaust slave piston, and (c) the hydraulic fluid supply.

20. The valve actuation system of claim 19 wherein the means for providing selective hydraulic fluid communication between the first hydraulic plunger and each of: (a) the intake slave piston, (b) the exhaust slave piston, and (c) the hydraulic fluid supply, comprises:

a hydraulic fluid system; and first and second control valves provided in the hydraulic fluid system, wherein the first control valve is positioned in the hydraulic fluid system to provide selective hydraulic communication of the first hydraulic plunger with the intake slave piston and the second control valve, and wherein the second control valve is positioned in the hydraulic fluid system to provide selective hydraulic communication of the first hydraulic plunger with the exhaust slave piston and the hydraulic fluid supply.

21. The valve actuation system of claim 20 wherein the means for providing selective hydraulic fluid communication between the second hydraulic plunger and each of: (a) the intake slave piston, (b) the exhaust slave piston, and (c) the hydraulic fluid supply, comprises:

the hydraulic fluid system; and third and fourth control valves provided in the hydraulic fluid system, wherein the third control valve is positioned in the hydraulic fluid system to provide selective hydraulic communication of the second hydraulic plunger with the exhaust slave piston and the fourth control valve, and wherein the fourth control valve is positioned in the hydraulic fluid system to provide selective hydraulic communication of the second hydraulic plunger with the intake slave piston and the hydraulic fluid supply.

22. The valve actuation system of claim 21, further comprising:

a first cam profile operatively connected to the first hydraulic plunger; and a second cam profile operatively connected to the second hydraulic plunger;

wherein plunger displacements produced by the first and second cam profiles are out of phase.

23. The valve actuation system of claim 22 wherein the plunger displacements are about 180 degrees out of phase.

24. The valve actuation system of claim 22 wherein the first cam profile is adapted to provide an intake valve opening motion and the second cam profile is adapted to provide an intake valve closing motion.

25. The valve actuation system of claim 21 further comprising a cam profile operatively connected to the first and second hydraulic plungers such that plunger displacements produced by the first and second hydraulic plungers are out of phase.

26. The valve actuation system of claim 25 wherein the plunger displacements produced by the first and second hydraulic plungers are about 180 degrees out of phase.

27. The valve actuation system of claim 21 wherein the hydraulic fluid supply includes an accumulator.

* * * * *